US007604530B2

(12) United States Patent
Shih

(10) Patent No.: US 7,604,530 B2
(45) Date of Patent: Oct. 20, 2009

(54) INLAID POLISHING PAD

(75) Inventor: Wen-Chang Shih, Taichung (TW)

(73) Assignee: IV Technologies Co., Ltd., Taichung (TW)

( * ) Notice: Subject to any disclaimer, the term of this patent is extended or adjusted under 35 U.S.C. 154(b) by 0 days.

(21) Appl. No.: 11/675,434

(22) Filed: Feb. 15, 2007

(65) Prior Publication Data

US 2007/0135030 A1 Jun. 14, 2007

Related U.S. Application Data

(62) Division of application No. 11/160,568, filed on Jun. 29, 2005, now Pat. No. 7,208,111.

(60) Provisional application No. 60/521,740, filed on Jun. 29, 2004.

(51) Int. Cl.
*B24D 11/00* (2006.01)

(52) U.S. Cl. ..... 451/527; 451/533; 451/528

(58) Field of Classification Search ..... 451/526–539
See application file for complete search history.

(56) References Cited

U.S. PATENT DOCUMENTS

| | | | | |
|---|---|---|---|---|
| 2,244,565 | A | | 6/1941 | Nast |
| 2,602,036 | A | | 7/1952 | Sullivan |
| 4,089,922 | A | | 5/1978 | Saito et al. |
| 4,389,454 | A | | 6/1983 | Horacek et al. |
| 5,212,910 | A | | 5/1993 | Breivogel et al. |
| 5,257,478 | A | | 11/1993 | Hyde et al. |
| 5,534,106 | A | * | 7/1996 | Cote et al. ..... 438/693 |
| 5,563,232 | A | | 10/1996 | Hurley et al. |
| 5,578,362 | A | | 11/1996 | Reinhardt et al. |
| 5,919,082 | A | * | 7/1999 | Walker et al. ..... 451/41 |
| 5,951,380 | A | * | 9/1999 | Kim ..... 451/65 |
| 5,962,142 | A | | 10/1999 | Tachi et al. |
| 6,017,265 | A | | 1/2000 | Cook et al. |
| 6,019,666 | A | | 2/2000 | Roberts et al. |
| 6,036,579 | A | | 3/2000 | Cook et al. |
| 6,126,532 | A | | 10/2000 | Sevilla et al. |
| 6,168,508 | B1 | | 1/2001 | Nagahara et al. |
| 6,197,692 | B1 | * | 3/2001 | Fushimi ..... 438/692 |
| 6,217,426 | B1 | | 4/2001 | Tolles et al. |
| 6,531,080 | B1 | | 3/2003 | Ehrfeld et al. |
| 6,544,107 | B2 | * | 4/2003 | Misra et al. ..... 451/41 |
| 6,579,604 | B2 | | 6/2003 | Obeng et al. |
| 6,585,579 | B2 | | 7/2003 | Jensen et al. |
| 6,592,443 | B1 | | 7/2003 | Kramer et al. |
| 6,645,265 | B1 | | 11/2003 | Wang |
| 6,648,733 | B2 | | 11/2003 | Roberts et al. |
| 6,777,455 | B2 | | 8/2004 | Seyanagi et al. |
| 6,857,941 | B2 | * | 2/2005 | Emami et al. ..... 451/41 |
| 7,090,570 | B2 | * | 8/2006 | Yun et al. ..... 451/287 |
| 2004/0055223 | A1 | | 3/2004 | Ono et al. |

* cited by examiner

*Primary Examiner*—Dung Van Nguyen
(74) *Attorney, Agent, or Firm*—Ditthavong, Mori & Steiner, P.C.

(57) ABSTRACT

A surface treatment or a two-step injection molding is used to make an inlaid polishing pad. A surface of the inlaid polishing pad has areas of different rigidity to control the rigidity and compressibility of the inlaid polishing pad. Furthermore, methods of making such an inlaid polishing pads are also disclosed.

27 Claims, 4 Drawing Sheets

INLAID POLISHING PAD

The present application is a divisional application of U.S. patent application Ser. No. 11/160,568 filed Jun. 29, 2005, now U.S. Pat. No. 7,208,111 which claims the priority benefit of U.S. Provisional Patent Application Ser. No. 60/521,740, filed Jun. 29, 2004, the full disclosures of which are incorporated herein by reference in their entirety.

BACKGROUND OF THE INVENTION

1. Field of Invention

The present invention relates to a polishing apparatus and manufacturing method thereof. More particularly, the present invention relates to an inlaid polishing pad and a method of producing the same.

2. Description of Related Art

During the manufacturing process of semiconductor integrated circuits, isolation structures, metal lines and dielectric layers are stacked layer by layer, causing the surface of a wafer to become less and less planar. Limited by the focus depth of an exposing machine, pattern transferal from a photomask to a photoresist layer becomes increasingly difficult, and the exposed pattern of the photoresist layer becomes increasingly distorted. Chemical mechanical polishing (CMP) is the only true global planarization process to resolve this problem.

In CMP, a wafer is pressed against and moved about on a polishing pad having polishing slurry thereon. The polishing slurry contains fine abrasive particles and a chemical reagent. Both the wafer and the polishing pad are rotated automatically; hence the wafer is planarized by both the mechanical polishing of the abrasive particles and by the chemical reaction with the chemical reagent.

An important goal of CMP is achieving uniform planarity of the wafer surface, and the uniform planarity also has to be achieved for a series of wafers processed in a batch. The rigidity (or stiffness) and the compressibility (or compliance) of a polishing pad greatly influence the planarity of the polished wafer. Generally speaking, the more rigid a polishing pad, the more planar a wafer polishes; and the more compressible a polishing pad, the more uniform a wafer polishes. Therefore, a wafer polished by a rigid polishing pad often needs to be further polished by a soft polishing pad to improve the polishing uniformity. The CMP process thus suffers from low throughput.

Conventionally, to satisfy both the planarity and the uniformity requirements of the CMP process, at least a layer of rigid pad and at least a layer of soft pad are stacked to form a desired composite polishing pad, such as the polishing pads disclosed by U.S. Pat. No. 5,212,910 and U.S. Pat. No. 5,257,478. As stated in U.S. Pat. No. 6,217,426, although a composite polishing pad can partially satisfy both the planarity and the uniformity requirements of the CMP process, some new problems are introduced. For example, pressure transmission is different for a rigid pad and a soft pad, and the polishing uniformity can sometimes be poor. Furthermore, the more layers that are stacked in a composite polishing pad, the more variable the rigidity and compressibility become and thus the more difficult to control are the polishing planarity and uniformity.

Besides, if the two pads in a composite polishing pad are not adhered together well enough, the composite polishing pad may easily delaminate during the polishing process. Therefore, U.S. Pat. No. 6,217,426 discloses a polishing pad having a pattern of protrusions on the mounting surface of the polishing pad to limit the pressure transmission area and increase the compressibility of the polishing pad.

In the prior art described above, the cost and complexity in producing a polishing pad are unavoidably increased.

SUMMARY OF THE INVENTION

In one aspect, the present invention provides an inlaid polishing pad having desired rigidity and compressibility to meet the requirements of polishing planarity and uniformity.

In another aspect, the present invention provides a method of producing an inlaid polishing pad having desired rigidity and compressibility, wherein a surface treatment or a two-step injection formation is used to make an inlaid polishing pad having areas of different rigidity to control the rigidity and compressibility of the inlaid polishing pad.

In accordance with the foregoing and other aspects of the present invention, an inlaid polishing pad is disclosed. The inlaid polishing pad comprises a body with a polishing surface on one side and a mounting surface on the other side, and a layer inlaid in the polishing surface and/or the mounting surface. The body is composed of a first polymer, and the inlaid layer is composed of a second polymer. The rigidities of the first polymer and of the second polymer are different.

According to a preferred embodiment of the present invention, the inlaid layer is formed by surface treating the first polymer. The method of the surface treatment is illuminating, heating, immersing or irradiating.

According to another preferred embodiment of the present invention, the first polymer and the second polymer are the same kind of polymer but have different polymerization densities or different foaming levels.

According to yet another preferred embodiment of the present invention, the first polymer and the second polymer are different kinds of polymer.

In accordance with the foregoing and other aspects of the present invention, a method of producing an inlaid polishing pad is disclosed. First, a semi-finished pad comprising a first polymer is formed. At least a surface of the semi-finished pad has at least a first region and at least a second region, and the thickness of the first region and the thickness of the second region are different. A surface treatment is performed to treat the surface of the semi-finished pad to form a surface treatment layer comprising a second polymer. The rigidity of the first polymer and the rigidity of the second polymer are different. The surface of the semi-finished pad is leveled to form a planar surface and leaves the surface treatment layer inlaid in the planar surface.

According to a preferred embodiment of the present invention, the surface treatment is illuminating, heating, immersing or irradiating.

In accordance with the foregoing and other aspects of the present invention, a method of producing an inlaid polishing pad is disclosed. A semi-finished pad comprising at least a polymer is formed by a two-step injection molding. The semi-finished pad has a body and a surface layer surrounding the body, and the semi-finished pad has at least a first region and at least a second region with different thicknesses. At least a surface of the pad is leveled to form a planar surface and leave the surface layer inlaid in the planar surface.

According to a preferred embodiment of the present invention, the body and the surface layer are composed of the same polymer but with different polymerization densities or different foaming levels.

According to another preferred embodiment of the present invention, the material of the body and the surface layer are different kinds of polymer.

In the foregoing, a surface treatment and a two-step injection molding are used to form a semi-finished pad. Then, the semi-finished pad is leveled to form the inlaid polishing pad. At least a surface of the inlaid polishing pad has at least two regions with different rigidities to satisfy the requirements of the polishing uniformity and planarity.

It is to be understood that both the foregoing general description and the following detailed description are made by use of examples and are intended to provide further explanation of the invention as claimed.

BRIEF DESCRIPTION OF THE DRAWINGS

The invention can be more fully understood by reading the following detailed description of the preferred embodiments, with reference made to the accompanying drawings as follows.

DESCRIPTION OF THE PREFERRED EMBODIMENTS

Figure 1:
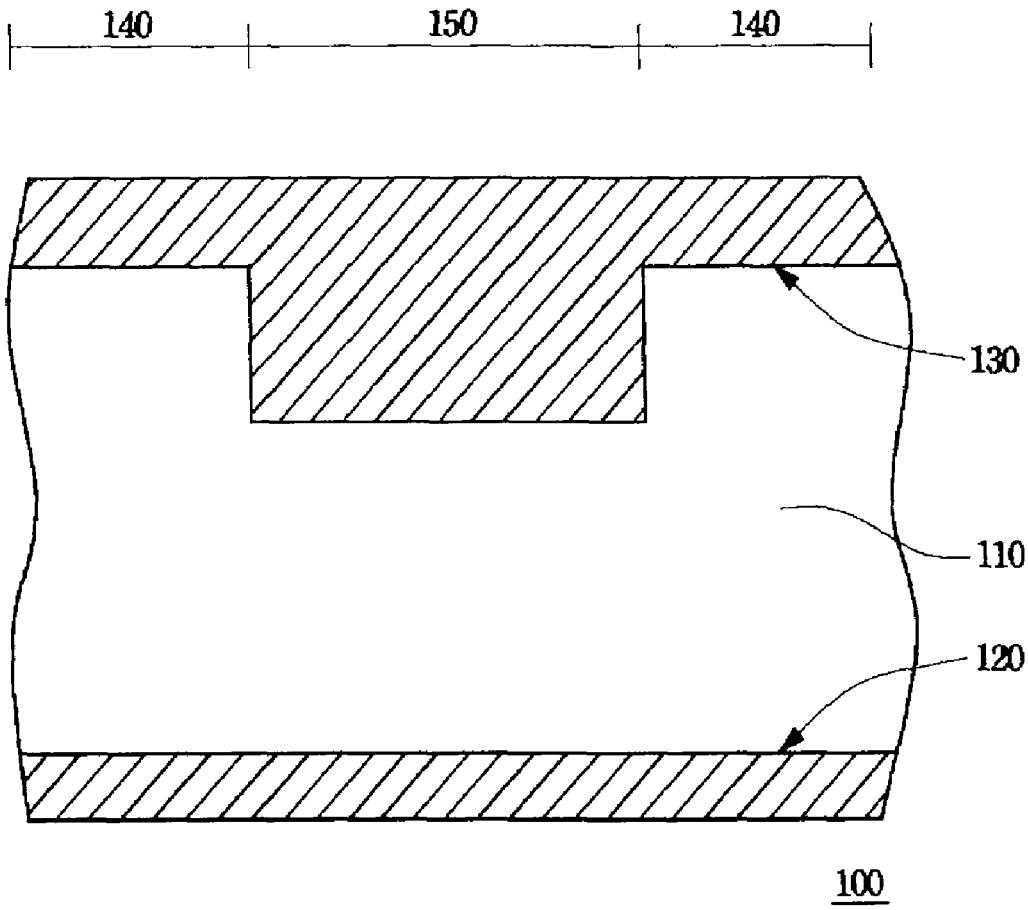
FIG. 1 is a cross-sectional diagram showing a mold according to a preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

This invention provides an inlaid polishing pad having desired rigidity and compressibility and a method of producing the same. Various processing procedures are used to produce regions with various rigidities to satisfy the polishing requirement of planarity and uniformity.

FIG. 1 is a cross-sectional diagram showing a mold according to a preferred embodiment of this invention. In FIG. 1, a mold 100 has a cavity 110, an interior bottom surface 120 is planar, and an interior top surface 130 is non-planar. Hence, the cavity 110 can be divided into at least two regions having different spacing. That is, a region 140 has a larger depth and a region 150 has a smaller spacing.

Embodiment 1

Figure 2A:
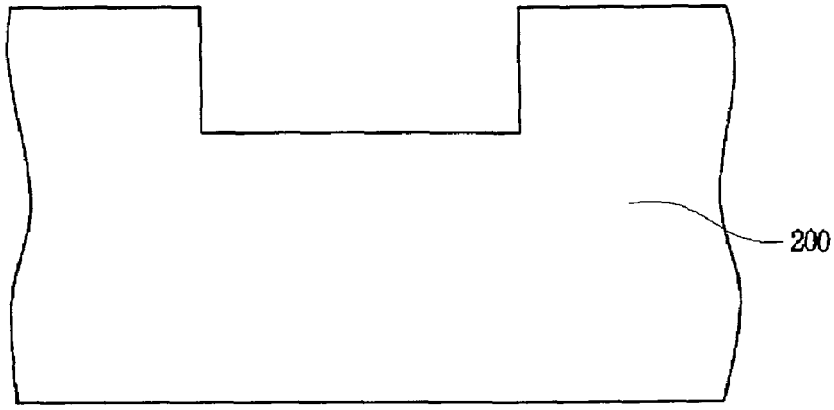
FIGS. 2A-2C are schematic, cross-sectional views showing a process of producing polishing pads according to a preferred embodiment of this invention.
Figure 2B:
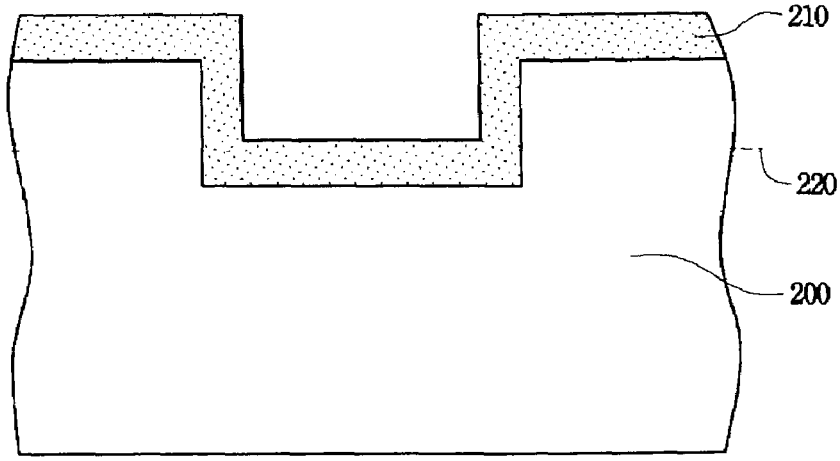
Figure 2C:
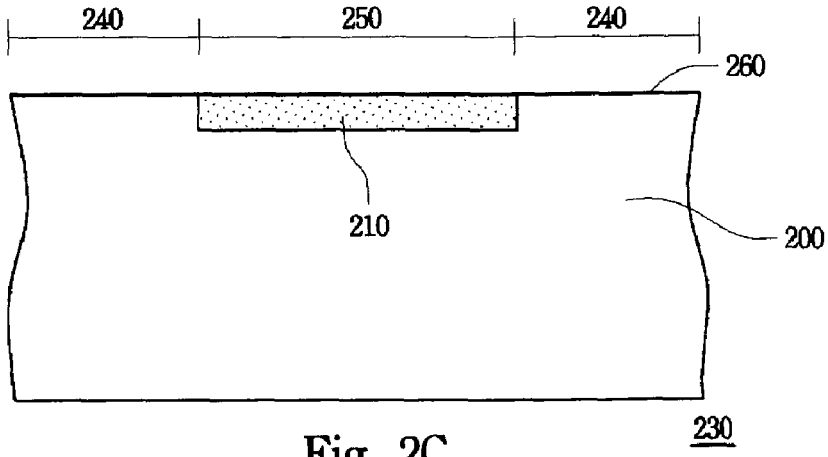

FIGS. 2A-2C are schematic, cross-sectional views showing a process of producing polishing pads according to a preferred embodiment of this invention. First, a polymer is molded in a cavity 110 of the mold 100 in FIG. 1 to form a semi-finished pad 200 with thicker and thinner regions, shown in FIG. 2A. In FIG. 2B, a surface treatment is performed on the top surface of the semi-finished pad 200 to form a treated layer 210 having different rigidity on the top portion of the semi-finished pad 200. The semi-finished pad 200 can be leveled along the line 220 shown in FIG. 2B to form a polishing pad 230, as shown in FIG. 2C. In FIG. 2C, the top surface 260 of the polishing pad 230 has at least two regions with different rigidities; that is, the region 240 and the region 250. The region 250 is formed by the treated layer 210 inlaid in the top surface 260.

According to a preferred embodiment, the surface treatment in the process of producing the polishing pad 230 can be illuminating to let the rigidity of the treated layer 210 become different from the rigidity of the semi-finished pad 200. For example, the polymer used to produce the polishing pad 230 includes a photo-polymerizable prepolymer having at least a photoreactive group that is capable of proceeding a photo-polymerization reaction. For example, the photoreactive groups include functional groups of acrylic acid series. Preferred functional groups of acrylic acid series include an acrylic functional group and a methacrylic functional group. The photoreactive groups also include other functional groups, such as epoxy series functional groups and other unsaturated functional groups.

Therefore, in FIG. 2B, the surface treatment can be illuminating the top surface of the semi-finished pad 200 to proceed the photo-polymerization reaction to form the treated layer 210 with higher rigidity. The light source used in the illuminating step can be a visible light source, a UV light source or other suitable light source that can enable the polymer of the semi-finished pad 200 to proceed a re-polymerization reaction.

According to another preferred embodiment, the surface treatment in the process of producing the polishing pad 230 can be heating to cause the rigidity of the treated layer 210 to become different from the rigidity of the semi-finished pad 200. For example, if the material of the semi-finished pad 200 is acrylic resin or polyurethane, heating can increase the cross-linkage percentage in the heated part of the semi-finished pad 200 to form the treated layer 210 with higher rigidity.

According to yet another preferred embodiment, the surface treatment in the process of producing the polishing pad 230 can be immersing to cause the rigidity of the treated layer 210 to become different from the rigidity of the semi-finished pad 200. For example, the immersing solutions can be a solution of epoxy resin, polyvinyl alcohol, or polyurethane. The immersing solutions can also be some organic solvents, such as toluene, xylene, N,N-dimethylformamide (DMF) or dichrolomethane. The semi-finished pad 200 can be immersed in the immersing solution by a batch type process or a continuous prepreg process to form the treated layer 210 with higher or lower rigidity.

According to again another preferred embodiment, the surface treatment in the process of producing the polishing pad 230 can be irradiating to cause the rigidity of the treated layer 210 to become different from the rigidity of the semi-finished pad 200. For example, if the material of the semi-finished pad 200 is polyethylene, polypropylene or fluorine resin, radiation can be used to produce free radicals in the irradiated part of the semi-finished pad 200 to generate a more cross-linked structure. Hence, the rigidity of the treated layer 210 is higher.

Embodiment 2

Figure 3A:
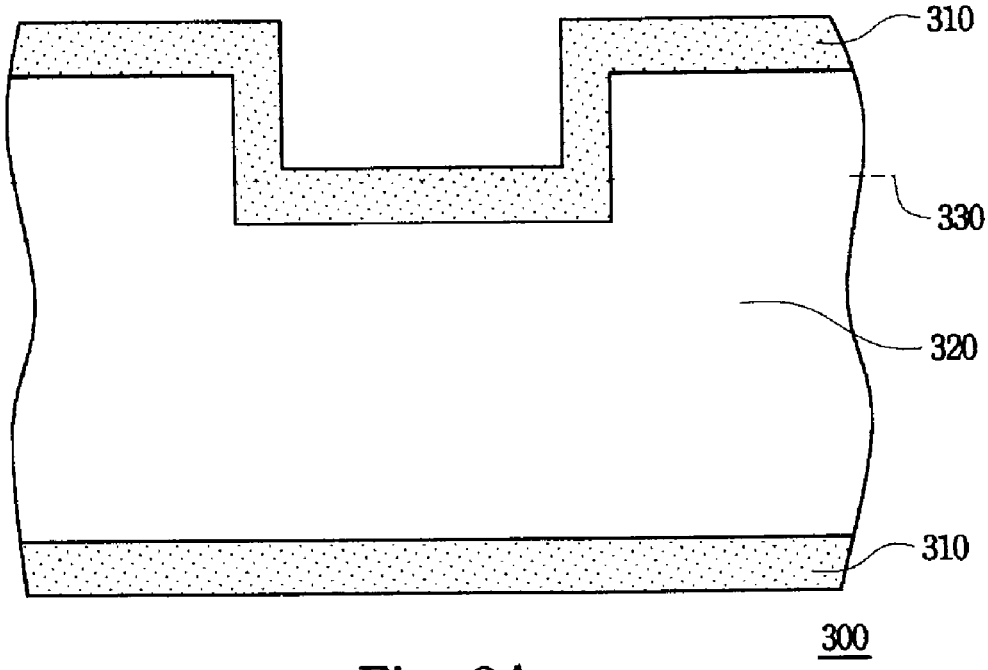
FIGS. 3A and 3B are schematic, cross-sectional views showing a process of producing polishing pads according to another preferred embodiment of this invention.
Figure 3B:
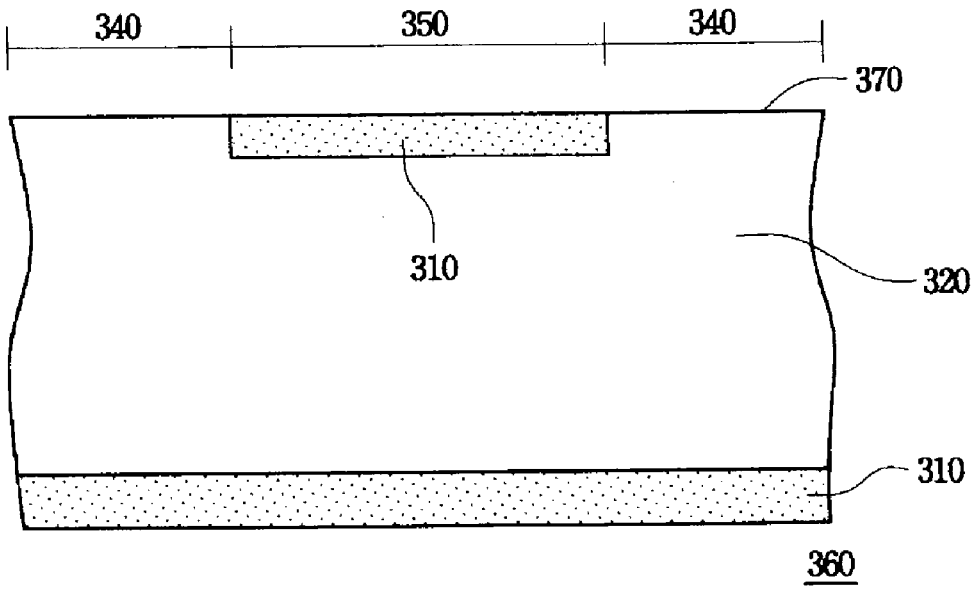

FIGS. 3A and 3B are schematic, cross-sectional views showing a process of producing polishing pads according to another preferred embodiment of this invention. With reference to FIGS. 1, 3A and 3B, first, a small amount of first polymer is formed in the cavity 110 of the mold 100 to form a surface layer 310, wherein the first polymer does not fully fill the cavity 110. The forming method of the first polymer includes injection molding or in-mold coating. Then, a second polymer is injected into the cavity 110 of the mold 100 to fully fill the volume surrounded by the surface layer 310, as shown in FIG. 3A.

The surface layer 310 and the body 320, formed by the method of the two-step injection molding, compose the semi-finished pad 300 with thinner and thicker regions in FIG. 3A. The semi-finished pad 300 is then leveled along the line 330 shown in FIG. 3A to form a polishing pad 360, as shown in FIG. 3B. In FIG. 3B, the top surface 370 of the polishing pad 360 has at least two regions with different rigidities; that is, the region 340 and the region 350. The surface layer 310 inlaid in the top surface 370 composes the region 350. If needed, the surface layer 310 on the bottom of the polishing pad 360 can be further removed to change the rigidity of the polishing pad 360.

According to a preferred embodiment, the first polymer and the second polymer can be the same kind of polymer. For example, the first polymer and the second polymer can both be polyurethane. However, the first polymer experiences one more thermal process or is added with a suitable hardener to increase the polymerization density. Therefore, the rigidity of the surface layer 310 is made higher than that of the body 320. Furthermore, the foaming levels of the first polymer and the second polymer are different; hence, the rigidity of the surface layer 310 and the body 320 are different.

According to another embodiment of the present invention, the first polymer and the second polymer can also be different kinds of polymer. For example, a more rigid polymer can be chosen to be the first polymer or the second polymer to cause the rigidities of the regions 340 and 350 to be different. For example, the material of the first polymer and the second polymer can be chosen from an epoxy resin, polyurethane, acrylic resin, polycarbonate and polyvinyl chloride.

Allocations of Soft Regions and Hard Regions on A Polishing Pad

The polishing pad 230 has regions 240 and 250 with different rigidities. The polishing pad 360 also has regions 340 and 350 with different rigidities. The allocation of these regions with different rigidities can be designed to produce a desired polishing pad. However, which regions are hard regions or soft regions of the regions 240 and 250 or the regions 340 and 350 depends on the process of producing the polishing pads 230 or 360.

Figure 4A:
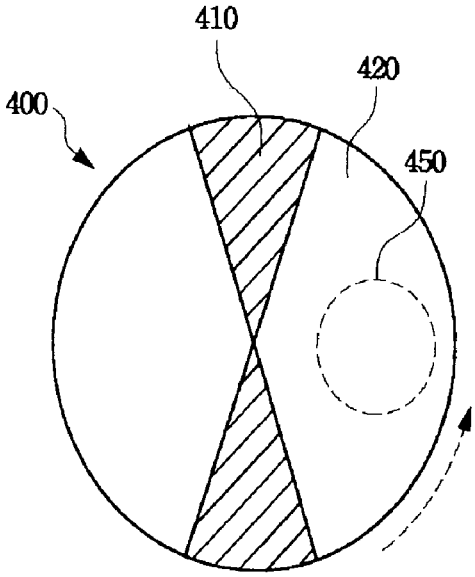
FIGS. 4A-4D are cross-sectional diagrams showing the distribution of soft regions and rigid regions on the polishing surface of the polishing pad.

FIGS. 4A-4D are cross-sectional diagrams showing the allocation of soft regions and rigid regions on a polishing pad according to preferred embodiments of the preset invention. In FIG. 4A, a circular polishing pad 400 is divided into several sectors, wherein the soft areas 410 and the rigid areas 420 are arranged alternately. The ratio of the surface area of the soft areas 410 to the surface area of the rigid areas 420 can be adjusted according to the desired polishing planarity and uniformity. When a wafer 450 moves around on the polishing pad 400, the wafer 450 passes the soft areas 410 and the rigid areas 420 sequentially. Hence, both the polishing uniformity and the polishing planarity can be achieved.

Figure 4B:
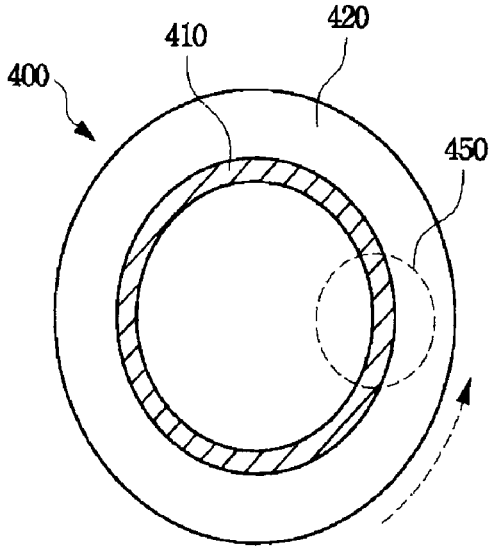
Figure 4C:
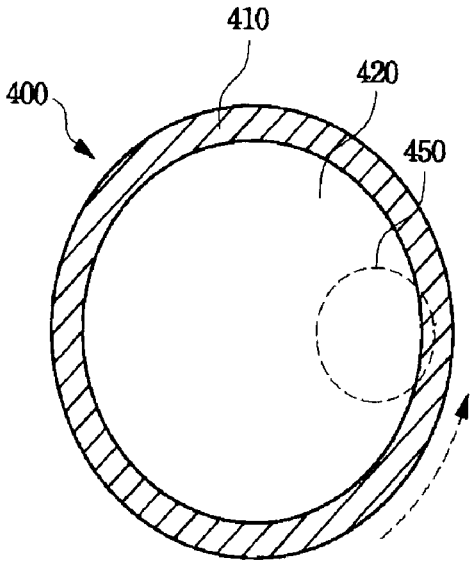
Figure 4D:
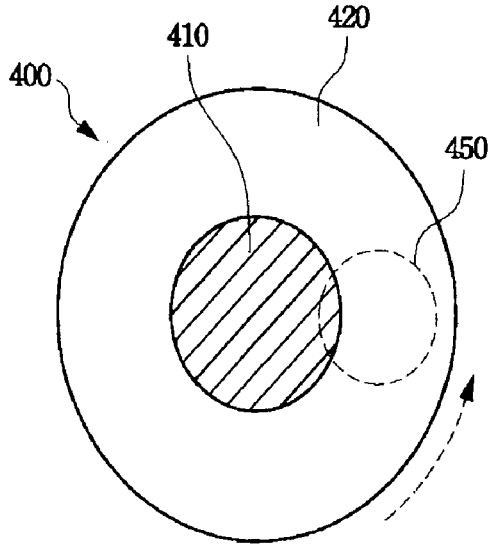

In FIG. 4B, the soft area 410 is located at the center of the passing area of the wafer 450. That is, the shape of the soft area 410 is like a ring located between the center and the circular edge of the polishing pad 400 to provide better polishing uniformity for the center region of the wafer 450. In FIG. 4C, the soft area 410 is located at the perimeter of the polishing pad 400 to provide better polishing uniformity for the edge region of the wafer 450. In FIG. 4D, the soft area 410 is circular and located at the central region of the polishing pad 400 to provide better polishing uniformity for the edge region of the wafer 450.

The allocation of the soft areas 410 and the rigid areas 420 on the polishing pad 400, as described above, can also be applied on a polishing surface and/or a mounting surface of the polishing pad 400. Therefore, the rigidity of the polishing pad 400 can be further adjusted to provide better polishing planarity and uniformity. Besides, the shape of the polishing pad 400 is not limited to a circle; the shape can also be, for example, a square or a rectangle. The allocation of the soft areas and rigid areas can also be varied according to the shape of the polishing pad and the desired polishing planarity and uniformity. Since anyone skilled in the art can adjust the relevant factors, a detailed discussion of the same is omitted here.

In light of foregoing, a mold having at least two different cavity spacing together with a surface treatment or a two-step injection molding are used to form a semi-finished pad. The semi-finished pad is then leveled to form a polishing pad having at least two regions with different rigidities on at least one surface of the polishing pad to control the rigidity and compressibility of the polishing pad. Therefore, not only can the requirements of lower cost and higher CMP process throughput be easily achieved, but the polishing planarity and uniformity can also be easily improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inlaid polishing pad, comprising:

a body comprising a first polymer;

a polishing surface on one side of the body;

a mounting surface on the other side of the body; and at least an inlaid layer inlaid in the polishing surface and/or the mounting surface, the inlaid layer comprising a second polymer, wherein the rigidity of the second polymer and the rigidity of the first polymer are different, wherein the second polymer is made by illuminating the first polymer to proceed a photo-polymerization reaction, heating the first polymer to increase cross-linkage, or irradiating the first polymer to generate a more cross-linked structure.

2. The inlaid polishing pad of claim 1, wherein the first polymer and the second polymer are the same kind of polymer.

3. The inlaid polishing pad of claim 2, wherein polymerization densities of the first polymer and of the second polymer are different.

4. The inlaid polishing pad of claim 1, wherein a shape of the inlaid layer is a sector, a ring or a circle.

5. The inlaid polishing pad according to claim 1, wherein the inlaid polishing pad is divided into sectors comprising a first region containing the first polymer and a second region containing the second polymer, such that during planarization of a substrate by chemical mechanical polishing, the substrate passes the first and second regions sequentially.

6. The inlaid polishing pad according to claim 1, wherein the polishing surface has been leveled.

7. The inlaid polishing pad according to claim 1, wherein the second polymer is made by illuminating the first polymer to proceed a photo-polymerization reaction, and a material of the first polymer has at least a photoreactive group including an acrylic acid series functional group, an acrylic functional group, a methacrylic functional group, an epoxy series functional group, an unsaturated functional group, and combination thereof.

8. The inlaid polishing pad according to claim 1, wherein the second polymer is made by heating the first polymer to increase cross-linkage, and a material of the first polymer is acrylic resin or polyurethane.

9. The inlaid polishing pad according to claim 1, wherein the second polymer is made by irradiating the first polymer to generate a more cross-linked structure, and a material of the first polymer is polyethylene, polypropylene, or fluorine resin.

10. An inlaid polishing pad for chemical mechanical polishing (CMP), the inlaid polishing pad being divided into at least a sector of a first region and at least a sector of a second region comprising an inlaid layer inlaid in a unitary body, wherein the first and second regions are alternately arranged such that, during planarization of a substrate by CMP, the substrate passes the first and second regions sequentially, wherein the inlaid layer is made by illuminating the unitary body to proceed a photo-polymerization reaction, heating the unitary body to increase cross-linkage, or irradiating the unitary body to generate a more cross-linked structure.

11. The inlaid polishing pad according to claim 10, wherein the inlaid polishing pad has a polishing surface and a mounting surface adapted to be mounted on a CMP apparatus, and the inlaid layer is inlaid in the polishing surface and/or the mounting surface.

12. The inlaid polishing pad according to claim 10, wherein the first sector contains a first polymer, and the second sector contains a second polymer.

13. The inlaid polishing pad according to claim 12, wherein the first and second polymers have different rigidities.

14. The inlaid polishing pad according to claim 12, wherein the first and second polymers are the same kind of polymer.

15. The inlaid polishing pad according to claim 10, wherein the inlaid layer is made by illuminating the unitary body to proceed a photo-polymerization reaction, and a material of the unitary body has at least a photoreactive group including an acrylic acid series functional group, an acrylic functional group, a methacrylic functional group, an epoxy series functional group, an unsaturated functional group, and combination thereof.

16. The inlaid polishing pad according to claim 10, wherein the inlaid layer is made by heating the unitary body to increase cross-linkage, and a material of the unitary body is acrylic resin or polyurethane.

17. The inlaid polishing pad according to claim 10, wherein the inlaid layer is made by irradiating the unitary body to generate a more cross-linked structure, and a material of the unitary body is polyethylene, polypropylene, or fluorine resin.

18. An inlaid polishing pad, comprising:

a body comprising a first polymer;

a polishing surface on one side of the body;

a mounting surface on the other side of the body; and at least an inlaid layer inlaid in the polishing surface and/or the mounting surface, the inlaid layer comprising a second polymer, wherein the second polymer is made by illuminating the first polymer to proceed a photo-polymerization reaction, heating the first polymer to increase cross-linkage, or irradiating the first polymer to generate a more cross-linked structure.

19. The inlaid polishing pad of claim 18, wherein the rigidity of the second polymer and the rigidity of the first polymer are different.

20. The inlaid polishing pad of claim 18, wherein a shape of the inlaid layer is a sector, a ring or a circle.

21. The inlaid polishing pad of claim 18, wherein the inlaid polishing pad is divided into sectors comprising a first region containing the first polymer and a second region containing the second polymer, such that during polishing of a substrate, the substrate passes the first and second regions sequentially.

22. The inlaid polishing pad according to claim 18, wherein the polishing surface has been leveled.

23. The inlaid polishing pad according to claim 18, wherein the second polymer has less un-reacted functional groups than the first polymer.

24. The inlaid polishing pad according to claim 18, wherein the second polymer has more cross-linkage percentage than the first polymer.

25. The inlaid polishing pad according to claim 18, wherein the second polymer is made by illuminating the first polymer to proceed a photo-polymerization reaction, and a material of the first polymer has at least a photoreactive group including an acrylic acid series functional group, an acrylic functional group, a methacrylic functional group, an epoxy series functional group, an unsaturated functional group, and combination thereof.

26. The inlaid polishing pad according to claim 18, wherein the second polymer is made by heating the first polymer to increase cross-linkage, and a material of the first polymer is acrylic resin or polyurethane.

27. The inlaid polishing pad according to claim 18, wherein the second polymer is made by irradiating the first polymer to generate a more cross-linked structure, and a material of the first polymer is polyethylene, polypropylene, or fluorine resin.

* * * * *